US011824315B2

(12) United States Patent
Hügel et al.

(10) Patent No.: US 11,824,315 B2
(45) Date of Patent: Nov. 21, 2023

(54) COAXIAL CONNECTOR AND CABLE ASSEMBLY

(71) Applicant: HUBER+SUHNER AG, Herisau (CH)

(72) Inventors: Ulf Hügel, Herisau (CH); Franz Manser, Herisau (CH)

(73) Assignee: HUBER+SUHNER AG, Herisau (CH)

( * ) Notice: Subject to any disclaimer, the term of this patent is extended or adjusted under 35 U.S.C. 154(b) by 152 days.

(21) Appl. No.: 17/433,172

(22) PCT Filed: Feb. 26, 2020

(86) PCT No.: PCT/EP2020/055051
§ 371 (c)(1),
(2) Date: Aug. 23, 2021

(87) PCT Pub. No.: WO2020/182471
PCT Pub. Date: Sep. 17, 2020

(65) Prior Publication Data

US 2022/0140547 A1 May 5, 2022

(30) Foreign Application Priority Data

Mar. 8, 2019 (CH) ..... 280/19

(51) Int. Cl.
*H01R 9/05* (2006.01)
*H01R 24/40* (2011.01)
(Continued)

(52) U.S. Cl.
CPC ..... *H01R 24/40* (2013.01); *H01R 9/0527* (2013.01); *H01R 13/5205* (2013.01);
(Continued)

(58) Field of Classification Search
CPC ..... H01R 9/05; H01R 9/0527; H01R 24/38; H01R 24/40; H01R 13/5205;
(Continued)

(56) References Cited

U.S. PATENT DOCUMENTS 3,671,922 A * 6/1972 Zerlin ..... H01R 9/0518 439/352
5,997,349 A 12/1999 Yoshioka
(Continued)

FOREIGN PATENT DOCUMENTS

| | | |
|---|---|---|
| CN | 103326190 A | 9/2013 |
| WO | WO 2017/158577 A1 | 9/2017 |
| WO | WO 2018/167210 A1 | 9/2018 |

OTHER PUBLICATIONS

EPO (Riswijk. NL), English language version of the International Search Report, Form PCT/ISA/210, for International Application PCT/EP2020/055051, dated May 13, 2020 (3 pages).

*Primary Examiner* — Thanh Tam T Le
(74) *Attorney, Agent, or Firm* — Pauley Erickson & Swanson

(57) ABSTRACT

A coaxial connector and a coaxial cable forming a cable assembly. The coaxial connector includes a cable entry side for entry of the coaxial cable and an opposite coupling side for coupling with the coaxial counter connector along the connector axis. The coaxial connector includes an inner contact element electrically connected with an inner conductor of the coaxial cable; an outer contact element electrically connected with an outer conductor of the coaxial cable; a dielectric connector element radially arranged between the inner contact element and the outer contact element; a connector housing arranged around the outer contact element; wherein the inner contact element is axially locked against the dielectric connector element and the dielectric connector element is axially locked against the connector housing such that the coaxial cable is strain relieved in an axial direction with respect to the connector housing.

25 Claims, 2 Drawing Sheets

(51) Int. Cl.
*H01R 13/52* (2006.01)
*H01R 13/58* (2006.01)
*H01R 13/627* (2006.01)
*H01R 13/639* (2006.01)

(52) U.S. Cl.
CPC ..... *H01R 13/5825* (2013.01); *H01R 13/6272* (2013.01); *H01R 13/639* (2013.01); *H01R 2201/26* (2013.01)

(58) Field of Classification Search
CPC ..... H01R 13/5825; H01R 13/6272; H01R 13/639; H01R 2201/26
See application file for complete search history.

(56) References Cited

U.S. PATENT DOCUMENTS 6,893,290 B2 * 5/2005 Buenz ..... H01R 24/566 439/578
7,635,283 B1 * 12/2009 Islam ..... H01R 13/5202 439/583
7,731,529 B1 * 6/2010 Islam ..... H01R 24/564 439/583
7,753,727 B1 * 7/2010 Islam ..... H01R 24/40 439/583
7,785,144 B1 * 8/2010 Islam ..... H01R 24/40 439/583
7,794,274 B2 9/2010 Phillips, Jr.
7,798,847 B2 * 9/2010 Islam ..... H01R 13/52 439/578
7,934,954 B1 * 5/2011 Chawgo ..... H01R 24/56 439/585
7,993,159 B2 * 8/2011 Chawgo ..... H01R 24/564 439/584
8,047,870 B2 * 11/2011 Clausen ..... H01R 24/564 439/578
9,614,302 B2 * 4/2017 Harwath ..... H01R 4/5033
9,837,761 B1 12/2017 Hardy et al.
10,468,786 B2 * 11/2019 De Cloet ..... H01R 24/38
10,637,186 B2 * 4/2020 Urtz, Jr. ..... H01R 24/525
10,666,000 B2 * 5/2020 Zheng ..... H01R 13/6658
10,950,970 B2 * 3/2021 Paynter ..... H01R 13/518
10,950,993 B2 * 3/2021 Zhang ..... H01R 13/50
2004/0218687 A1 11/2004 Santhoff
2008/0233796 A1 9/2008 Segrt
2011/0182583 A1 7/2011 Rakib
2014/0218635 A1 8/2014 Imlenburg et al.
2015/0318599 A1 11/2015 Ivanov et al.

* cited by examiner

COAXIAL CONNECTOR AND CABLE ASSEMBLY

CROSS REFERENCE TO RELATED APPLICATION

This application is a National Phase filing in the United States, under 35 USC § 371, of PCT International Patent Application PCT/EP2020/055051, filed on 26 Feb. 2020 which claims the priority of Swiss Patent Application CH 00280/19, filed 8 Mar. 2019.

These applications are hereby incorporated by reference herein in their entirety and is made a part hereof, including but not limited to those portions which specifically appear hereinafter.

BACKGROUND OF TIE INVENTION

Field of the Invention

The present invention relates to a coaxial connector and cable assembly, a coaxial connector, coaxial counter connector, as well as a coaxial cable.

Discussion of Related Art

The automotive industry is facing profound changes in that companies out of the field of and consumer electronics compete with traditional car manufacturers. Advanced driver assisting systems and fast moving towards to automated driving request radical changes of the system architecture of the car electronics. High numbers of sensors and actuators in combination with centralized high-performance computers (super computers) and self-learning (AI) algorithms path the way to cope with the complexity of autonomous driving in a real world dynamically changing environment.

A prerequisite for such an architecture are fast and reliable data transmission between different computing units, sensor units (Lidar, Radar, Camera, etc.) and communication units, etc., thereby allowing fast and efficient data processing and exchange with other traffic participants and infrastructure.

Although optical fiber links would fit quite well with requirements such as sufficient data rate, low electromagnetic interference and small cable diameters. However, they have some serious draw backs, in that the electro-optical transceivers are very expensive (orders of magnitude above coper based data transmitters) and the tight optical alignment tolerances in the sub-micron range make this technology sensitive to vibration and thermal shock as typical in automotive applications. Therefore, such technology causes serious reliability and safety concerns. Furthermore, the fiber optical transceivers consume significant more energy compared to cooper lines with length below 10 to 15 m as needed in cars.

For high speed and/or high volume data transmission on short distances copper based differential signal transmission nowadays is predominant in the industry. Differential signal transmission uses cables comprising one or several pairs of parallel conductors wherein the information is represented by a difference in voltage between the parallel conductors, hereinafter called twisted pair transmission lines. The data is represented by polarity reversals on the conductor pair and the receiver analyze the relative voltage difference to determine its logical value such as 0 or 1. The advantage of this transmission method is that interference voltages induced by magnetic fields occur in both conductors with similar levels and so not affecting the voltage difference. The residual difference of the induced voltage due to the slightly spatial displacement is often further reduced by twisting the parallel conductors with respect to each other. However, with increasing data rates the number of polarity changes in time and accordingly the operating frequency on the transmission line increases. With frequencies approaching the GHz range, slightly geometric differences between the paired conductors causing skew will convert some energy of the common mode into the differential mode. So shielded parallel pair or twisted pair cable try to reduce the common mode interference but the interconnectivity from cable to transceiver typically reveal significant holes in the shield allowing especially at higher frequencies electromagnetic waves to ingress. Due to high frequency induced interference combined with the exponential increasing attenuation of parallel pair cables reduce the signal to interference ratio rapidly and limit the maximum operation frequency even for the typical short cable length in cars.

Increasing the number of logical values from only distinguishing positive or negative voltage between the two conductors to 4, 8 or even 16 different amplitude levels allow to increase data rate without increasing the operation frequency, but requires significant better signal to interference ratios. The number of amplitude levels which improve the data throughput seem to find their optimum by 8 to 16 levels. To further increase of data rate, the data stream is split into multiple separate streams and transported via multiple parallel pairs of conductor cables. This significantly increases the weight, dimension and cost of the communication link.

WO 18167210 A1, first published in September 2018 on behalf of Technetix BV, is directed to transporting digital data over a coaxial cable. Digital signals associated with data are converted into data electrical signals. At least one repeater station is positioned along a coaxial cable restoring digital signals from the data electrical signals at the repeater station. The digital signals are converted back into data electrical signals at the repeater station for onward transmission. Typically, a plurality of repeater stations is disposed at spaced-apart intervals along the coaxial cable with each repeater station comprises a receiver and transmitter. The receiver is receiving data electrical signals and restoring these into digital signals with the transmitter converting the digital signals back into data electrical signals for onward transmission. The data electrical signals have a frequency of at least 2 GHz.

US 2015318599 A, first published in November 2015 on behalf of Microchip Technology Ing., is directed to data communication having improved electromagnetic interference (EMI) rejection when communicating through a coaxial cable. The data communication uses differential transmission and/or reception through a common-mode choke and a dissipative element resulting in extremely low radiated emissions and high immunity to external radiation interference in a low-cost way.

CN 103326190 A, first published in September 2013 on behalf of Huawei Technologies Co. Ltd., is directed a shielding structure for a radio frequency coaxial connector and a set top box provided with the shielding structure. The shielding structure comprises a circuit board and the radio frequency coaxial connector. The circuit board is further provided with a circuit module. A shielding case which covers the circuit module and partially covers the radio frequency coaxial connector is connected to the circuit board.

US 2014218535 A, first published in June 2017 on behalf of Manga Electronics Inc., is directed to a vision system for a vehicle. It includes an imaging sensor disposed at the vehicle and having an exterior field of view. A control is disposed at the vehicle and a coaxial cable is in communication between the imaging sensor and the control. The vision system communicates image data captured by the imaging sensor to the control and supplies power to the imaging sensor via the coaxial cable. The coaxial cable may include an inner core comprising copper, a dielectric medium, a foil screen, an outer conductor comprising copper, a separating layer and an outer sheath. When initially powering up the vision system, a transceiver of the imaging sensor may be tuned to an initial communication mode, which is suitable for communication with at least one of the controls, a communication interface of the vision system and a display device of the vision system.

US 2011182583 A, first published in July 2013 on behalf of Gainspeed Inc., is directed to a distributed CMTS device for a HFC CATV network serving multiple neighborhoods by multiple individual cables, in which the QAM modulators that provide data for the individual cables are divided between QAM modulators located at the cable plant, and remote QAM modulators ideally located at the fiber nodes. A basic set of CATV QAM data waveforms may be transmitted to the nodes using a first fiber, and a second set of IP/on-demand data may be transmitted to the nodes using an alternate fiber or alternate fiber frequency, and optionally other protocols such as Ethernet protocols. The nodes will extract the data specific to each neighborhood and inject this data into unused QAM channels, thus achieving improved data transmission rates through finer granularity. A computerized "virtual shelf" control system for this system is also disclosed. The system has high backward compatibility, and can be configured to mimic a conventional cable plant CMTS.

US 2004218687 A, first published in November 2004 on behalf of Pulse Link Inc., is directed to an ultra-wideband pulse modulation system and method. It includes a method of transmitting a plurality of ultra-wideband pulses, wherein each ultra-wideband pulse represents a data symbol. The modulation and pulse transmission method of the present invention enables the simultaneous coexistence of the ultra-wideband pulses with conventional carrier-wave signals. The present invention may be used in wireless and wired communication networks such as hybrid fiber-coax networks. This Abstract is provided for the sole purpose of complying with the Abstract requirement rules that allow a reader to quickly ascertain the subject matter of the disclosure contained herein. This Abstract is submitted with the explicit understanding that it will not be used to interpret or to limit the scope or the meaning of the claims.

SUMMARY OF THE INVENTION

It is an overall objective of the present invention to improve the state of the art regarding data transmission, in particular, high-volume and/or high-speed data transmission. In particular, data transmission shall be improved in harsh environments, as typically present, for example, in automobiles. Such harsh environments may concern temperature conditions, mechanical conditions, in particular mechanical shocks or vibrations, and/or electromagnetic interferences.

Alternative to twisted pair transmission lines in automotive application coaxial cable transmission is often chosen. The possibility to provide DC-power supply and data transfer over the same single cable make this method very attractive to connect sensors like cameras or radars. Furthermore, coaxial cables can operate up to frequencies one or two order of magnitudes above parallel pair cables.

Known coaxial cables have the drawback to be very sensitive against interference at low frequencies below (10 to 1000 MHz). Missing the self-cancelation effect of differential mode transmission, these cables have to rely on the isolation of the currents from the inner side of the shield (and outer conductor) to currents on the outer side of the shield (and outer conductor) caused by the skin effect. The skin depth is usually defined as the depth below the surface of the conductor at which the current density has fallen to 1/e (about 0.37) from its value at the surface.

To achieve reasonable attenuation, the thickness of the outer conductor should be in the range of several skin depths (10 . . . 20). This leads to heavy and very stiff cables whereas the stiffness is normally improved by substituting the outer conductor tube (e.g., semi rigid cables) by single or double braid. However, the braided outer conductor implies multiple openings in the outer shield reducing the shield efficiency with increasing frequency.

One aspect of the present invention is to provide a reliable single cable based transmission system which is cost efficient and which allows digital data transmission beyond 20 GBit/s with high immunity to electromagnetic interference. For this purpose, a coaxial connector and cable assembly is provided.

In a variation the objectives are achieved by using a coaxial cable in combination with a frequency modulation scheme (e.g., QPSK, CDMA, OFDM, . . . ) as typical used for wireless data transmission. Thereby, the operating frequency band can be shifted to higher frequencies (e.g., above 2 GHz) avoiding poor interference immunity of coaxial cables at lower frequencies. As a consequence, the need for outer conductors with large thickness can be avoided too.

Furthermore, a coherent transmission will allow to get advantage to distinguish between 256 . . . 4098 symbols not only by amplitude but as well by their phase and so e.g., a 30 GBit/s data stream would occupy with a 4098 QAM modulation less than 3.5 GHz of bandwidth. Although the operation frequency is shifted upward, the maximum operation frequency is lowered compared to a state of the art PAM16 modulation with the same data rate. Being able to shift the operating frequency band allows similar as in wireless communication to operate in frequency domain duplex operation operating a forward and a backward channel e.g., with carrier center frequency at 4 GHz and 9 GHz respectively.

In the past, a disadvantage of such modulation was the large complexity of the modem resulting in high power consumption large size and cost. Furthermore, significant effort has to be taken to control the analogue mixer part over the required large operation temperature range.

Surprisingly it turned out that due to advances in semiconductor technology particularly in mixed signal silicon CMOS technology a realization of fully digital transceiver with direct AD/DA conversion on one single silicon die is feasible. As an example, a quadrature amplitude modulation (QAM) modem may operate with a symbol rate of about 3000 Msyb/s. Depending on the modulation type ranging from 256QAM to 4096QAM data rates of 20 GBit/s to 30 GBit/s could be achieved occupying a spectral bandwidth of about 3.5 GHz. So, a frequency domain duplex operation with e.g., low band at 2.5 GHz . . . 6 GHz and high band at 8 GHz . . . 10.5 GHz could be realized over one coaxial cable. Today such a modem could be built in one single mixed signal silicon die. Furthermore, direct radio frequency (RF) synthesis and RF sampling with direct analog to digital (ADC) and digital to analog (DAC) conversion require minimal external analog RF circuitry, thereby helping to keep complexity, reliability, power efficiency and cost under control. Some or all of the here-described functionality may be realized by way of an RF semiconductor component as further mentioned below.

A coaxial cable build with a thin solid metal outer conductor, e.g., a metal foil or metal plated polymer tape, provides an almost perfect shield at frequencies above 2 GHz. Such a coaxial cable is comparatively light weight, low cost and provides good flexibility, although it is difficult to contact the outer conductor to a connector body.

Moving the mechanical strain relief away from the outer conductor preventing cracking of the fragile cable outer conductor (foil or plated tape) to the inner conductor allows to use a circumferential attached sleeve on the fragile outer conductor foil making a sliding contact to the connector body. Circumferential attachment of the inner and/or outer conductor can e.g., be achieved by welding, gluing, soldering or clamping. The inner conductor will provide the mechanical strain relief, e.g., a 1 mm diameter copper wire could provide the typical requested retention force for coaxial cable in automotive standard of 110N. If higher forces are needed e.g., a copper plated steel wire can be used as inner conductor to increase the tensile force to 300N and above. An outer jacket respectively connector housing made from polymer can be foreseen to hinder kinking of the cable and to provide sufficient torsion stability and environmental protection to the cable.

The circumferential attachment as described hereinafter in more detail will provide a continuous shield with no negative openings from the outer conductor of the coaxial cable to the sleeve. The sleeve should contact the connector body in a way that allows rotational and axial movement, while keeping any holes and gaps in the shield orders of magnitude smaller than the wavelength at the maximum operating frequency. Such contact could for example be realized with a stamped/bended collar out of thin wall sheet metal. To enable the cable tensile force to the inner conductor special attention to the coaxial bead is necessary. The right insulating respectively dielectric material in combination with an appropriate design have to be chosen to provide sufficient clamping force of the inner conductor in the connector body. Good results can be achieved by e.g., fiber reinforced LCP, Peek, PPS, PA or a combination thereof.

The desired immunity against electromagnetic interference can be achieved by carefully shielding the complete transmission path from transmitter to receiver (or in the duplex case from transceiver to transceiver), respectively an RF semiconductor component.

To achieve good shielding performance for a coaxial connector interface, the goal is to avoid any openings or holes. Screwed interfaces like SMA provide a circumferential contact when well tightened. But screwed connectors have the disadvantage that tightening is inconvenient (applying the right torque normally requires a torque wrench) and unintended loosening (e.g., due to vibration, wrong torque, torque applied on the cable) is a serious reliability issue. For this reason, a snap-on connection as described hereinafter in more detail is preferred in certain fields of application. In a preferred variation, the connector contacts the outer shield (outer conductor) of the coaxial cable with at least one spring loaded contact interrupted by several slots and/or gaps causing electromagnetic leakage.

In a variation, the mechanical alignment and fixation function is decoupled from the contact and shielding function. This allows miniaturization of the spring elements and wall thickness. Preferred are stamped and bended sheet metal resulting in slots and gaps smaller than, e.g., 1.0 mm, allowing operation with good shielding at higher frequencies (e.g., up to 20 GHz). Furthermore, this construction allows radial and axial misalignment to compensate manufacturing and assembly tolerances especially between housing, PCB and (multiple) connector(s) which allow significant miniaturization of the connector dimensions. For this purpose, an additional movable, in particular, swiveling compensation element may be foreseen as explained further blow in more detail.

The resulting floating construction allows mechanical coupling (and if wanted locking) between cable connector body and an electronic device or module housing or chassis as explained further below. The coupling geometry may be integrated in a housing or chassis be attached as separate part (e.g., press fit or screwed). In this way, the mating and retention force goes directly to the housing or chassis and does not cause any mechanical stress, e.g., to the solder joints from connector housing to PCB as in state of the art coaxial PCB connector solutions. Furthermore, sealing of a device or module housing against water and other substances as well as electromagnetic shielding of the connector penetration of the housing becomes possible.

Following the transmission path from silicon die to silicon die respectively semiconductor component to semiconductor component, the section from silicon die respectively semiconductor component to coaxial connector is sensible to electromagnetic leakage as several electrical interfaces are involved without an integral shielding concept. State of the art silicon packages interconnect the silicon die to outer solderable pins in the package (different packaging methods exist—e.g., wire bonding to frame, interposer circuit boards with ball grid arrays). This package is typically connected via a PCB to PCB-coaxial-connector(s). All this transmission lines are more or less unshielded and cause serious EMI (Electro Magnetic Interference) issues. This situation gets even worse for modules or devices with several high speed/high volume data lines where several interconnections are located in immediate vicinity to each other.

The proposed solution provides continuous shielding for the complete section from silicon die respectively semiconductor component to the coaxial connection. The coaxial PCB connector housing encloses the silicon package respectively semiconductor component with an upper opening to allow reflow soldering and visual inspection of the solder joints. A continuous ground layer in at least one of the PCB layers if necessary completed with a via fence close the shielding to the bottom. A shielding cover which would be attached to the connector after the soldering process completes the shielding. A heat transfer coupling, e.g., by a heat transfer material, such as e.g., thermal conductive paste, between the cover and the chip package may allow to use the connector as heat sink for the transceiver. The design should keep gaps and slots between the spring loaded contact elements smaller than. e.g., 1.0 mm allowing operation with good shielding up to 20 GHz. Such a cover could be realized in thin wall stamped and bended sheet metal or deep drawing. The shielding enclosure inner volume should stay sufficient small not allowing hollow waveguide modes to propagate, as such resonances would significant negatively affect electromagnetic leakage. If the silicon package requires a larger volume that is enclosed by the shielding, such that hollow waveguide mode resonances may occur, absorbing elements may be additionally inserted.

The connectivity from a semiconductor component, in particular a transceiver, to further components or devices such as centralized computing units, control units, sensor units (Lidar, Radar, Camera) and communication units could be preferable realized when the transceiver chip is located on the main circuit board of the device. To connect the high data rate a serializer/deserializer (SerDes) may be included in the coax-transceiver die and connecting via package pins and solder to multiple parallel lines on the PCB to other components preferable complying with a data transmission protocol for PCB (e.g., ETHERNET 25GBASE-KR/KR-S or n×10GBASE-KR).

Such circuit board is susceptible to electromagnetic interference and need to be protected against emission or ingression of radiation by an adequate shielding enclosure. All connectivity to the outer world has to penetrate this shielding enclosure. With state of the art connectors this penetration is realized with an exemption in the shield creating a not desirable significant opening in the shielding enclosure. As mentioned above the flexible construction with a barrel allow to close this opening in the penetration area with contact elements although misalignment due to the tolerance chain cannot be avoided.

In a preferred design, a coaxial connector and cable assembly comprises a coaxial connector and a coaxial counter connector interconnectable to each other along a connector axis, as well as a coaxial cable interconnected to the coaxial connector. The coaxial connector has a cable entry side for entry of the coaxial cable and an opposite coupling side for coupling with the coaxial counter connector along the connector axis. The coaxial connector includes an inner contact element (11), the inner contact element being electrically connected with an inner conductor of the coaxial cable. The coaxial connector further includes an outer contact element, the outer contact element being electrically connected with an outer conductor (23) of the coaxial cable. The coaxial connector further includes a dielectric connector element, the dielectric connector element being radially arranged between the inner contact element and the outer contact element. The coaxial connector further includes a connector housing, the connector housing being arranged around the outer contact element.

The inner contact element is axially locked against the dielectric connector element and the dielectric connector element is axially locked against the connector housing such that the coaxial cable is strain relieved in axial direction with respect to the connector housing. Strain relief is according to this design achieved via the inner contact element and the dielectric connector element rather than via the outer conductor of the coaxial cable.

In an embodiment, the dielectric connector element is axially locked against the outer contact element and the outer contact element is axially locked against the connector housing. In such embodiment, the locking of the dielectric connector element is axially locked against the connector housing via the outer contact element as intermediate element. In alternative embodiments, the dielectric connector element is directly axially locked against the connector housing.

In an embodiment, each of the locking is a positive locking. In particular, each of the locking of the inner contact element against the dielectric connector element, of the dielectric connector element against the outer contact element, and of the outer contact element against the connector housing area is a positive locking. Similarly, a direct axial locking of the dielectric connector element against the connector housing in an alternative embodiment may be a positive locking.

In an embodiment, the coaxial connector includes a contact sleeve for radial arrangement between the outer conductor of the coaxial cable and the outer contact element, thereby electrically coupling the outer conductor of the coaxial cable and the outer contact element. In some of those embodiments, the contact sleeve is arranged displaceable relative to the contact element.

In some embodiments with a contact sleeve, the contact sleeve includes a plurality of radial spring elements by which the contact sleeve is interconnected to the outer contact element. Further in some embodiments with a contact sleeve, the contact sleeve includes a plurality of radial spring elements by which the contact sleeve is interconnected to the outer contact element.

In some embodiments, a compensation element is arranged between the coaxial connector and the coaxial counter connector. Like the coaxial connector and the coaxial counter connector, the compensation element comprises an inner conductor and an outer conductor in coaxial arrangement. The compensation element serves the purpose of compensating for radial and/or angular tolerances and misalignment between the coaxial connector and the coaxial counter connector.

In some embodiments with a compensation element, the compensation element is arranged moveable with respect to the coaxial connector and/or the coaxial counter connector. The compensation element may in particular, be arranged to allow a swiveling movement. In some embodiments, the compensation element is attached, in particular, permanently attached, to the coaxial connector or the coaxial counter connector.

In some embodiments, the coaxial connector includes a connector sealing element at the cable entry side, the connector sealing element being radially arranged between a sheath of the coaxial cable and the outer contact element to provide scaling with respect to at least one out of the group of liquid, humidity, particles, electromagnetic interference. The connector sealing element may be designed as gasket. Similarly, the counter connector may in some embodiments include a counter connector sealing element.

In some embodiments, the coaxial connector includes a connector locking structure. Further, the coaxial connector and cable assembly comprises a counter connector locking structure for axial locking the coaxial connector relative to the coaxial counter connector. The counter connector locking structure of such embodiment may in particular, be realized integrally with a counter connector housing or a chassis as explained further below.

In some embodiments with a locking structure, connector locking structure and the counter connector locking structure form a snap-on connection. In some of such embodiments, one of the connector locking structure and the counter connector locking structure comprises a latch and the other of the connector locking structure and the counter connector locking structure comprises a hook. The snap-on connection is achieved by way of engagement between latch and hook. In some of those embodiments, the latch and/or the hook are arranged displaceable.

In some of the inner contact element of the coaxial connector is a jack. In such embodiments, the inner counter contact element of the coaxial counter connector or the inner contact element of a compensation element, if present, is pin-shaped and received by the jack.

In some embodiments, the outer conductor of the cable is a metal foil or a metal plated polymer tape. In such embodiment it is particularly favorable that strain relief is achieved via the inner conductor of the coaxial connector as explained before, rather than via the outer conductor of the coaxial cable, since a metal foil or metal plated polymer tape are not suited for transmitting significant forces, in particular axial pulling forces, in contrast to a braided outer conductor.

In some embodiments, the coaxial connector and cable assembly includes a chassis, wherein the coaxial counter connector is permanently coupled to the chassis. A printed circuit board may be mounted within the chassis, wherein an RF semiconductor component is mounted on the printed circuit board. An electrical shielding may be provided, the electrical shielding encapsulating the RF semiconductor component. The electrical shielding and the outer counter contact element are electrically connected to a ground (GND) potential. In a state where the coaxial connector is coupled with the coaxial counter connector, the connector locking structure and the counter connector locking structure engage.

The chassis may for or part of a casing of an electronic device or module, e. g., a computing device, sensor assembly, sensor evaluation device or control device of an automobile, and/or form generally part of a device or a machine, for example an automobile body.

In some embodiments, the counter connector locking structure is formed integrally with the chassis.

In some embodiments, the electrical shielding is interconnected to at least one ground layer of the printed circuit board.

In some embodiments, a counter connector housing is formed integrally with the chassis In a further aspect, the overall objective is achieved by a coaxial connector for use in a coaxial connector and cable assembly as described above and/or further below.

In a further aspect, the overall objective is achieved by a coaxial counter connector for use in a coaxial connector and cable assembly as described above and/or further below.

In a further aspect, the overall objective is achieved by a coaxial cable for use in a coaxial connector and cable assembly as described above and/or further below.

In a further aspect, the overall objective is achieved by using a coaxial connector and cable assembly as described above and/or further below for data transmission in an automobile.

It is to be understood that both the foregoing general description and the following detailed description present embodiments, and are intended to provide an overview or framework for understanding the nature and character of the disclosure. The accompanying drawings are included to provide a further understanding, and are incorporated into and constitute a part of this specification. The drawings illustrate various embodiments, and together with the description serve to explain the principles and operation of the concepts disclosed.

BRIEF DESCRIPTION OF SEVERAL VIEWS OF THE DRAWINGS

The herein described invention will be more fully understood from the detailed description given herein below and the accompanying drawings which should not be considered limiting to the invention described in the appended claims. The drawings are showing:

DETAILED DESCRIPTION OF THE INVENTION

In the following, exemplary embodiments are explained in more detail with additional reference to the figures. It is to be understood that all directional terms, such as "top", "bottom", "left", right", "upper", lower", "above, "below", etc. refer to the figures and are sole intended to improve the reader's understanding. They do not imply any particular orientation in use. The same applies to references to the coordinate system that is additionally shown in the figures.

Figure 3:
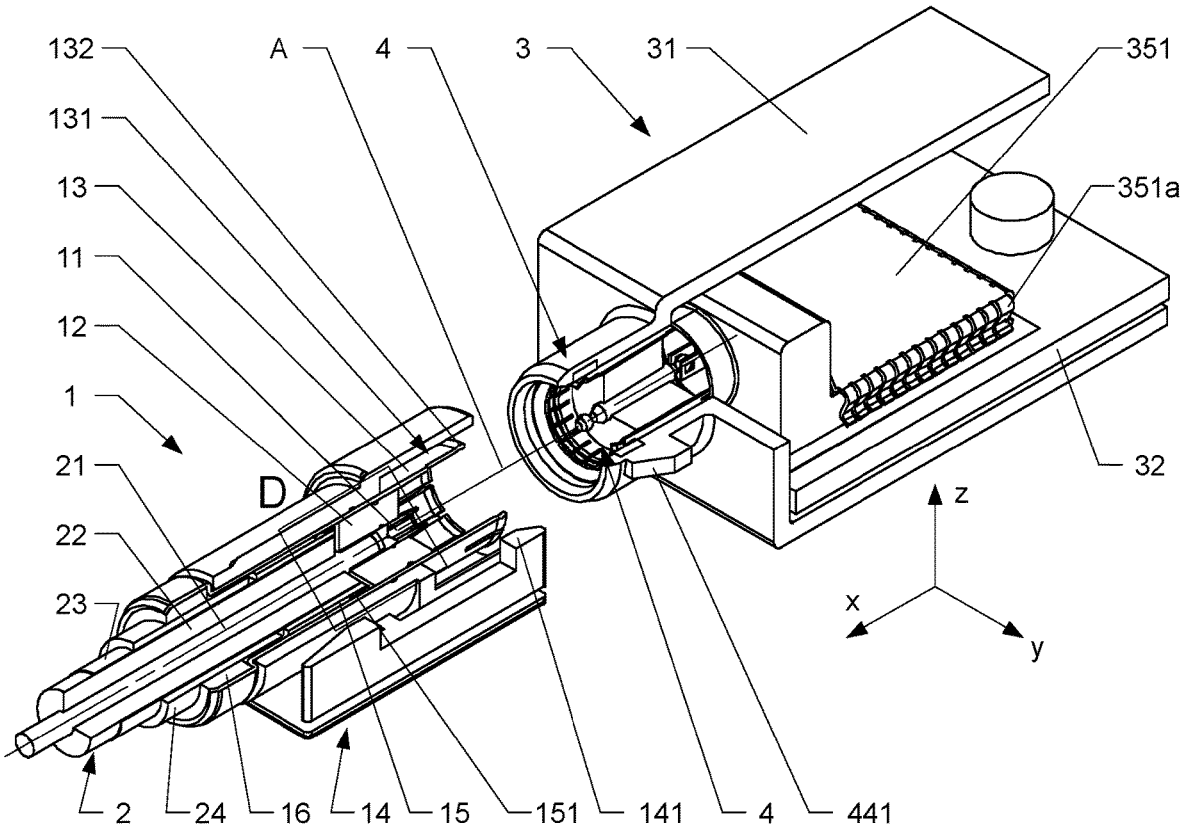
FIG. 3 shows the coaxial connector and cable assembly of FIG. 1 in an unconnected and axially aligned state of coaxial cable connector and cable counter connector.

A coaxial connector 1 (generally best seen in FIGS. 3, 4) comprises inner contact element 11 outer contact element 13, and insulating dielectric connector element 12 in coaxial arrangement with respect to connector axis A (parallel to x-axis). The connector axis A extends from the cable entry side on the left towards the coupling side on the right of coaxial connector 1. The inner contact element 11 is realized as jack with a tubular end section (not individually referenced) to receive a portion of an inner counter connector part a coaxial counter connector 4 respectively a compensation element 5 as explained further below in more detail. The opposite (left) end of inner contact element 11 is electrically connected to the inner conductor 21 of coaxial cable 2, for example by way of soldering, crimping or welding or a combination thereof.

A connector housing 14 of preferably made of dielectric respectively electrically insulating material, typically plastics, is arranged around the outer contact element 13. The connector housing 14 comprises a connector locking structure 141 in form of a catch for locking the coaxial connector t in an assembled state via a snap-on connection as explained further below.

The outer contact element 13 is realized as thin metallic tube and extends in axial direction towards the inner contact element 11 at the coupling side (right). Further at the coupling side, the outer contact element 13 comprises a plurality of axial slits, thereby forming a corresponding plurality of finger-like radial spring elements 131 that exert a radial force when deflected. At the end, the outer contact element 13 respectively the spring elements 131 form outwards-directed bulges 132. The bulges 132 and the spring elements 131 serve for electrical coupling with an outer counter contact element of a coaxial counter connector 4 as explained further below in more detail.

At the cable entry side, a ring-shaped connector scaling element 16 in form of a gasket is radially arranged between the outer contact element 13 and the sheath 24 of coaxial cable 2.

Electrical coupling of the outer conductor 23 of coaxial cable 2 and outer contact element 13 is realized via metallic tubular contact sleeve 15 that is radially arranged between outer conductor 23 on the inside and outer contact element 13 on the outside. Towards the coupling side of coaxial connector 1, contact sleeve 15 comprises a plurality of radial spring elements 151 that ensure good electrical contact with the inner surface of outer contact element 13. Axially, the outer conductor 23 and the dielectric layer 22 of coaxial cable 2 end substantially flush with the contact sleeve 15.

The dielectric connector element 12 is axially arranged adjacent respectively with an axial gap to contact sleeve 15 towards the coupling side of coaxial connector 1, a rear portion (towards the cable entry side) of the inner contact element 11 and a front portion (towards the coupling side) of the inner conductor 21 are arranged in a through-going axial bore of dielectric connector element 12. Towards the coupling side, the inner contact element 11 axially projects beyond the dielectric connector element 12. The circumferential outer surface of dielectric element 12 contacts the circumferential inner surface of outer contact element 13.

Figure 4:
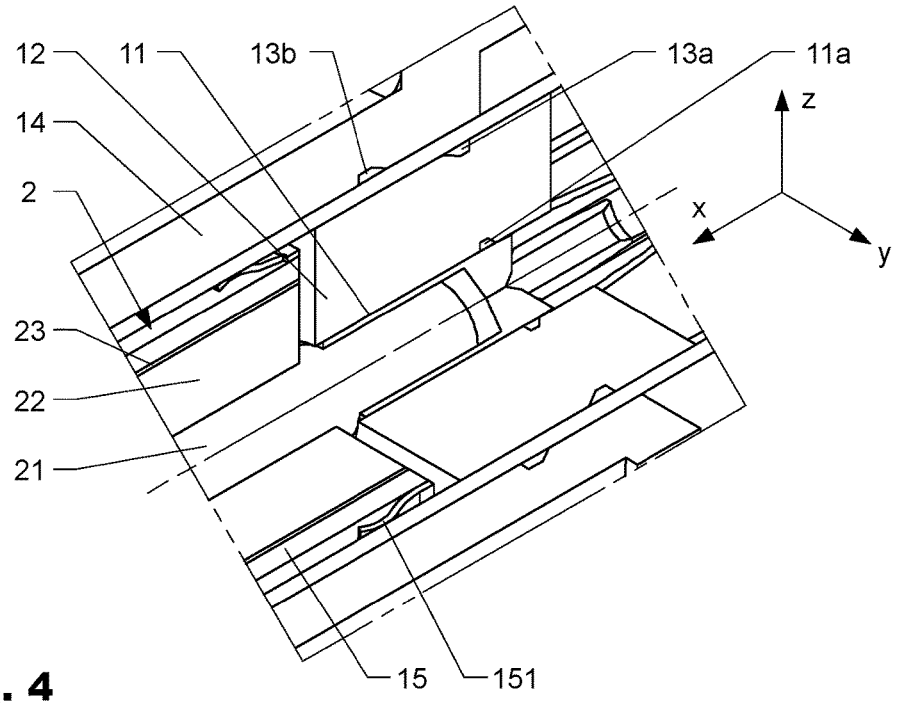
FIG. 4 Shows detail D as indicated in FIG. 3 in an enlarged view.

The dielectric connector element 12 serves a number of purposes. First, it positions the inner contact element 11 and the outer contact element 12 with respect to each other. Second it serves, due to its dielectric properties, as electrical and electromagnetic insulation in the RF operation frequency range. Third, it serves, together with further connector components, as strain relief. As best seen in FIG. 4, the inner contact element 11 has at its circumferential outer surface, a radial rim 11*a* that engages a corresponding radial groove (not referenced) on the circumferential inner surface of dielectric connector element 12, thereby positively locking inner contact element 11 with respect to dielectric connector element 12. Further, dielectric connector element 12 has at its circumferential outer surface, a radial groove (not referenced) which is engaged by a circumferential radial rim 13*a* on the circumferential inner surface of outer contact element 13. Further, outer contact element 13 has at its circumferential outer surface and axially displaced with respect to radial rim 13*a*, a further radial rim 13*b* that engages a groove (not referenced) of the inner surface of connector housing 14. Each of the rims 11*a*, 13*a*. 13*b* and the corresponding grooves form a positive locking structure. In this way, the inner contact element 11 is positively locked against the dielectric connector element 12, the dielectric connector element 12 is positively locked against the outer contact element 13, and the outer contact element 13 is positively locked against connector housing 14. Consequently, all axial force and in particular pulling stress (in positive x-direction) that is exerted onto the coaxial cable 2, is transferred from the inner conductor 21 via the inner contact element 11, the dielectric connector element 12 and the outer contact element 13 to the connector housing, without involving the outer conductor 23 of coaxial cable 2 which does accordingly not need to be designed to withstand high axial forces respectively stress. In an alternative design, the dielectric connector element 12 could be directly positively locked with the connector housing 14 rather than via the outer contact element 13.

Figure 1:
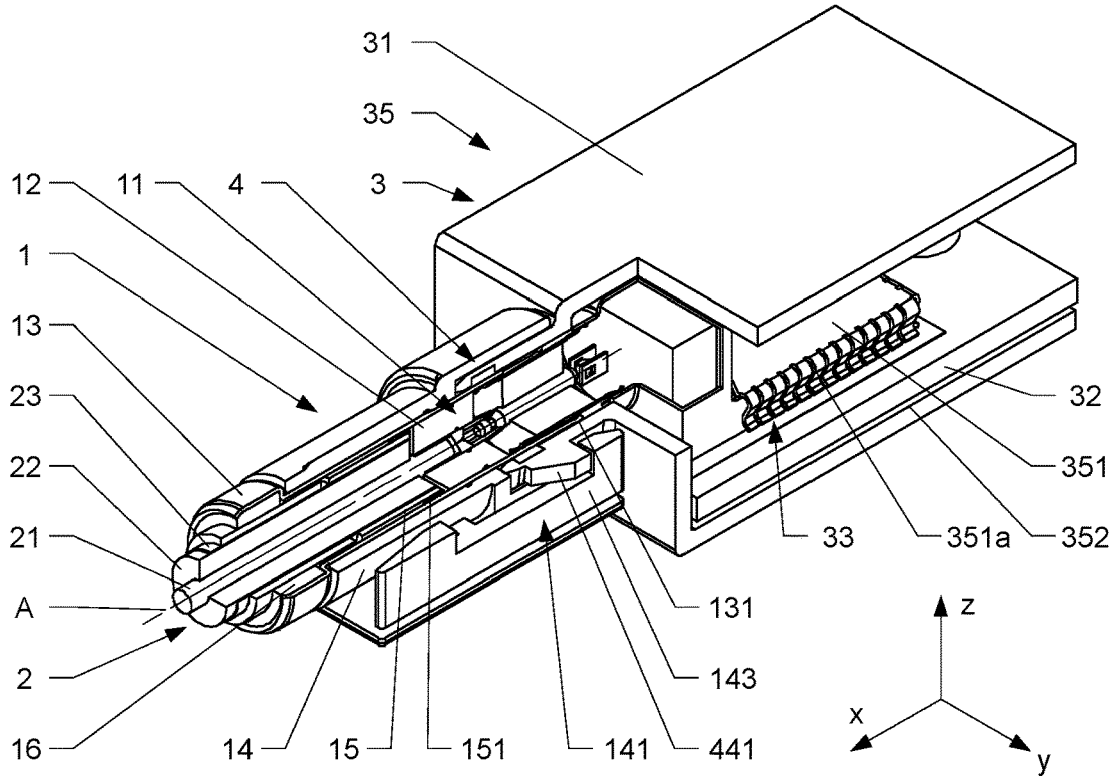
FIG. 1 shows an embodiment of a coaxial connector and cable assembly in accordance with a present invention in a perspective and partly sectional view in a connected state of coaxial connector and coaxial counter connector.
Figure 2:
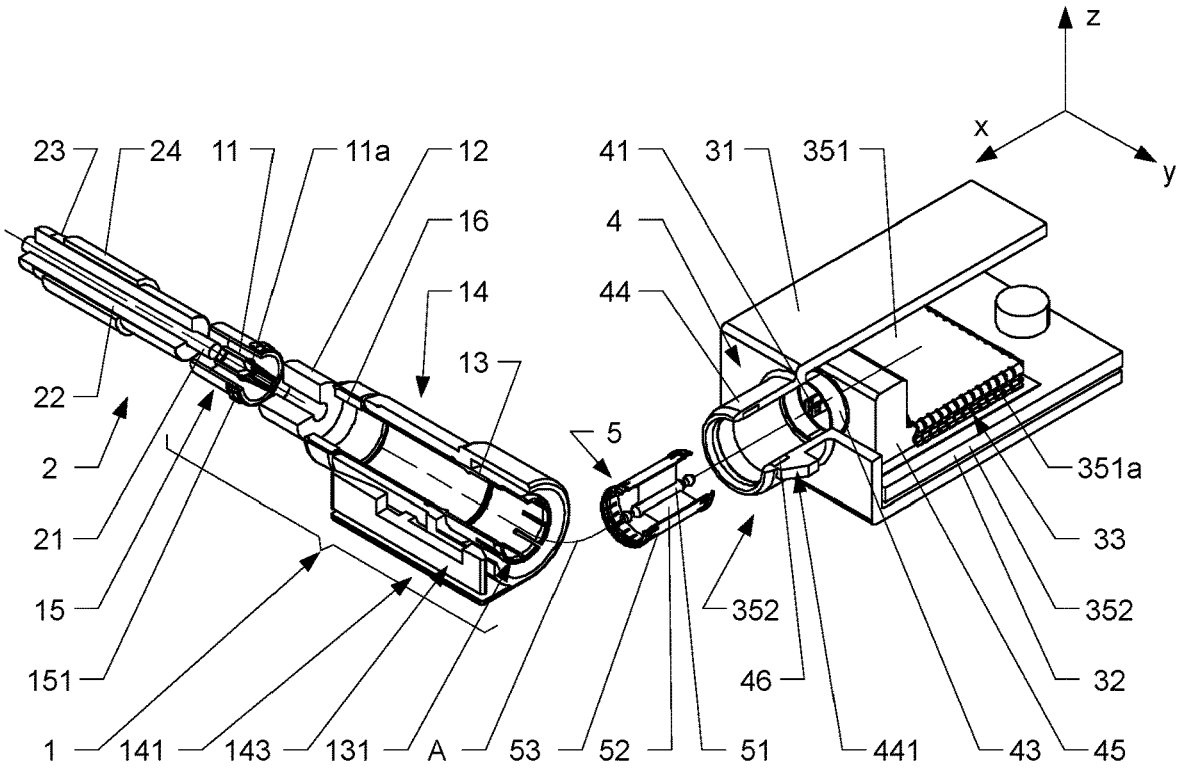
FIG. 2 shows the coaxial connector and cable assembly of FIG. 1 in an unconnected and unaligned state of coaxial connector and coaxial counter connector with a compensation element arranged between them.

As best visible in FIG. 1 and FIG. 2, an RF device 3 of the coaxial connector and cable assembly 100 comprises a chassis 31 in which a PCB 32 is rigidly mounted. The PCB 32 carries electronic components as generally known in the art and in particular surface-mounted RF semiconductor component 33 on its top surface. The RF semiconductor component 33 is covered by an electrical cover element 351. Generally, the RF semiconductor component 33 is sandwiched (in direction of the z-axis) between the PCB 32 and the cover element 351. The cover element 351 is electrically connected to a ground (GND) potential on the PCB 32 substantially along its whole circumference thereby electromagnetically shielding RF semiconductor component 33. For this purpose, cover element 351 comprises a plurality of individual segments or fingers 351 along its circumference. The RF semiconductor component 33 may in particular be or comprise a sender, receiver or transmitter as discussed in more detail above in the general description.

The chassis 31 further carries the coaxial counter connector 4 for coupling with the coaxial connector 1. The coaxial counter connector 4 is accordingly fixed to the chassis and forms part of the RF device 3 in this embodiment. The coaxial counter connector 4 comprises an inner counter contact element 41 and an outer counter contact element 43 in coaxial arrangement. The inner counter contact element 41 projects from an insulating respectively dielectric carrier 45 and is electrically coupled with an input and/or output port of the RF semiconductor component 33. The outer counter contact element 43 is of tubular shape and arranged around the inner counter contact element 41. The outer counter contact element 43 is electrically coupled to the ground level.

Further, a compensation element 5 is present in the shown embodiment. Similar to the coaxial connector 1 and the coaxial counter connector 4, the compensation element 5 comprises a coaxial arrangement of an inner contact element 51, an outer contact element 53 and a dielectric element 52. The dielectric element 52 is arranged within the outer contact element 53 and carries the inner contact element 51 in a central bore. Both the outer contact element 53 and the inner contact element 51 axially project on both sides beyond the dielectric element 52.

Electrically, the compensation element 5 is arranged between the coaxial connector 1 and the coaxial counter connector 4, with the inner contact element 51 coupling of the compensation element 5 coupling the inner contact element 11 of the coaxial connector 1 with the inner counter contact element 41 of the coaxial counter connector 4, and the outer contact element 53 of the compensation element 5 coupling the outer contact element 13 of the coaxial connector 1 with the outer counter contact element 43 of the coaxial counter connector 4.

Axially and radially, the compensation element 5 overlaps with the coaxial connector 1 and the coaxial counter connector 4. In the shown embodiment, the inner contact element 51 of compensation element 5 has the shape of an elongated pin with ball-shaped axial end sections that are separated from a main body of the inner contact element 51 by circumferential grooves (best seen in FIG. 2, not individually referenced). One of the end sections is hold by the inner counter contact element 41 in an axially fixed but swiveling manner, with the end section of the inner contact element 51 of compensation element 5 and the inner counter contact element 41 forming a ball bearing (best seen in FIGS. 1, 3). The other axial end section of inner contact element 51 is dimensioned to be received in a tubular end section of inner contact element 11 of the coaxial connector 11. The outer contact element 53 of the compensation element 51 is dimensioned to be received within the outer contact element 13 of coaxial connector 1 and within the outer counter contact element 43 of coaxial counter connector 4. Similar to the lingers respectively radial spring elements 131 and bulges of outer contact element 13 as explained before, the outer contact element 53 of compensation element 5 comprises, in both axial end sections, segmented to form a plurality of radial spring elements with bulges (not individually referenced, best seen in FIGS. 2, 3). Thereby, the outer contact element 53 of compensation element 5 is allowed to swivel and/or slide within an inner surface of outer contact element 13 and outer counter contact element 43, while maintaining electrical contact.

Due to its inner contact element 51 being axially fixed by inner counter contact element 41, the compensation element 5 is permanently coupled to the coaxial counter connector 4 and may be considered as forming part thereof. In a variant, the ball bearing is formed between the inner contact element 11 of the coaxial connector 11 and the inner contact element SI of the compensation element 51. In such embodiment, the compensation element 5 is permanently coupled to the coaxial connector 1 rather than the coaxial counter connector 4.

Due to its swiveling arrangement, the compensation element 5 compensates for tolerances and axial/angular misalignment between the coaxial connector 1 and the coaxial counter connector 4.

The counter connector 4 further comprises a counter connector housing 44 that is arranged circumferentially around the outer counter contact element 43 and is, in this embodiment, formed integrally with the chassis 31. In a direction towards the coaxial connector 1, the counter connector housing 44 axially projects beyond the compensation element 5 and the counter connector 4. In a connected state of coaxial connector 1 and coaxial counter connector 4, the coaxial counter connector housing 44 is radially revived between the connector housing 14 and the outer contact element 13. A counter connector sealing element 46 in form of a gasket is provided similar to the before-described connector sealing element 16 on the circumferential inner surface of the counter connector housing 44, thereby proving sealing against the outer contact element 13 of the coaxial connector 1. Alternatively, to the counter connector housing 44 being formed integrally with the chassis 31, it could be a separate element end rigidly attached to the chassis 31. In both cases, any force and/or moment that is exerted on the coaxial connector 1 and/or the coaxial cable 2 is transmitted to the chassis and does not affect the electrical coupling between the coaxial connector 1 and the coaxial counter connector 4.

The coaxial connector 1 and the coaxial counter connector 4 are designed for axial coupling via a snap-fit coupling. For this purpose, the coaxial connector housing comprises a latch 141 with an oblique gliding surface 141*a*. As counter connector locking structure, a hook 441 is provided at the outer circumference of the counter connector housing 44 with an oblique gliding surface 441*a*. For connecting respectively coupling the coaxial connector 1 and the coaxial counter connector 4, they are moved towards each other along the connector axis A such that the gliding surfaces 141*a*, 441*a* come in contact. The latch 141 is arranged in a radially resilient manner, thereby allowing to deflected outwards. Consequently, the hook 441 is locked by latch 141. For decoupling, a cable sided end section of the latch 141 is pressed radially inwards, resulting in the end of the latch 141 pointing towards the counter connector 4 being radially deflected outwards, such that the latch 441 and the hook 441 disengage.

The invention claimed is:

1. A coaxial connector and cable assembly (100) comprising:

a coaxial connector (1) and a coaxial counter connector (4) interconnectable to each other along a connector axis (A) as well as a coaxial cable (2) interconnected to the coaxial connector (1);

the coaxial connector (1) having a cable entry side for entry of the coaxial cable (2) and an opposite coupling side for coupling with the coaxial counter connector (4) along the connector axis (A), the coaxial connector (1) including:

a) an inner contact element (11), the inner contact element (11) being electrically connected with an inner conductor (21) of the coaxial cable (2);

b) an outer contact element (13), the outer contact element (13) being electrically connected with an outer conductor (23) of the coaxial cable (2);

c) a dielectric connector element (12), the dielectric connector element (12) being radially arranged between the inner contact element (11) and the outer contact element (13);

d) a connector housing (14), the connector housing (14) being arranged around the outer contact element (13); and e) wherein the inner contact element (11) is axially locked against the dielectric connector element (12) and the dielectric connector element (12) is axially locked against the connector housing (14) such that the coaxial cable (2) is strain relieved in axial direction with respect to the connector housing (14), wherein all axial force and pulling stress that is exerted onto the coaxial cable (2) is transferred from the inner conductor (21) via the inner contact element (11), the dielectric connector element (12), and the outer contact element (13) to the connector housing, without involving the outer conductor (23) of the coaxial cable (2).

2. The coaxial connector and cable assembly (100) according to claim 1, wherein the dielectric connector element (12) is axially locked against the outer contact element (13) and the outer contact element (13) is axially locked against the connector housing (14).

3. The coaxial connector and cable assembly (100) according to claim 2, wherein each of the locking of the inner contact element (11) against the dielectric connector element (12), of the dielectric connector element (12) against the outer contact element (13), and of the outer contact element (13) against the connector housing (14) area is a positive locking (13*a*, 13*b*).

4. The coaxial connector and cable assembly (100) according to claim 1, wherein the coaxial connector (1) includes a contact sleeve (15) for radial arrangement between the outer conductor (23) of the coaxial cable (2) and the outer contact element (13), thereby electrically coupling the outer conductor (23) of the coaxial cable (2) and the outer contact element (13).

5. The coaxial connector and cable assembly (100) according to claim 4, wherein the contact sleeve (15) is arranged displaceable relative to the contact element (13).

6. The coaxial connector and cable assembly (100) according to claim 4, wherein the contact sleeve (15) includes a plurality of radial spring elements (151) by which the contact sleeve (15) is interconnected to the outer contact element (13).

7. The coaxial connector and cable assembly (100) according to claim 1, wherein a compensation element (5) is arranged between the coaxial connector (1) and the coaxial counter connector (4).

8. The coaxial connector and cable assembly (100) according to claim 7, wherein the compensation element (5) is arranged in a swiveling manner with respect to the coaxial connector (1) and/or the coaxial counter connector (4).

9. The coaxial connector and cable assembly (100) according to claim 7, wherein the compensation element (5) is attached to the coaxial connector (1) or the coaxial counter connector (4).

10. The coaxial connector and cable assembly (100) according to claim 1, wherein the coaxial connector (1) includes a connector sealing element (16) at the cable entry side, the connector sealing element (16) being radially arranged between a sheath (24) of the coaxial cable (2) and the outer contact element (13) to provide sealing with respect to at least one out of the group of liquid, humidity, particles, electromagnetic interference.

11. The coaxial connector and cable assembly (100) according to claim 1, wherein the inner contact element (11) is a jack.

12. The coaxial connector and cable assembly (100) according to claim 1, wherein the outer conductor of the cable (2) is a metal foil or a metal plated polymer tape.

13. The coaxial connector and cable assembly (100) according to claim 1, wherein the connector housing (14) includes a connector locking structure (141) and the coaxial connector and cable assembly (100) further includes a counter connector locking structure (441) for axial locking the coaxial connector (1) relative to the coaxial counter connector (4).

14. The coaxial connector and cable assembly (100) according to claim 13, wherein the connector locking structure (141) and the counter connector locking structure (441) form a snap-on connection.

15. The coaxial connector and cable assembly (100) according to claim 14, wherein one of the connector locking structure (141) and the counter connector locking structure (441) comprises a latch and the other of the connector locking structure (141) and the counter connector locking structure (441) comprises a hook.

16. The coaxial connector and cable assembly (100) according to claim 15, wherein the latch (141) and/or the hook (441) are arranged displaceable.

17. The coaxial connector and cable assembly (100) according to claim 13, further comprising:

i. a chassis (31), wherein the coaxial counter connector (4) is permanently coupled to the chassis (31);

ii. a printed circuit board (32) mounted within the chassis (31), wherein an RF semiconductor component (33) is mounted on the printed circuit (32) board;

iii. an electrical shielding (35), the electrical shielding (35) encapsulating the RF semiconductor component (33), wherein the electrical shielding (35) and the outer counter contact element (43) are electrically connected to a ground (GND) potential:

wherein in a state where the coaxial connector (1) is coupled with the coaxial counter connector (4), the connector locking structure (141) and the counter connector locking structure (441) engage.

18. The coaxial connector and cable assembly (100) according to claim 17, wherein the counter connector locking structure (441) is formed integrally with the chassis (31).

19. The coaxial connector and cable assembly (100) according to claim 17, wherein the electrical shielding (35) is interconnected to at least one ground layer of the printed circuit board (32).

20. A coaxial connector (1) according to claim 1.

21. A coaxial counter connector (4) according to claim 1.

22. A coaxial cable (2) according to claim 1.

23. Use of a coaxial connector and cable assembly (100) according to claim 1 for data transmission in an automobile.

24. Use of a coaxial connector and cable assembly (100) according to claim 1 in combination with a data modem operating in a frequency modulation scheme.

25. Use of a coaxial connector and cable assembly (100) according to claim 1 in combination with a data modem operating in a frequency modulation scheme and frequency domain duplex operation.

* * * * *